US006060709A

United States Patent [19]

Verkuil et al.

[11] Patent Number: 6,060,709

[45] Date of Patent: May 9, 2000

[54] APPARATUS AND METHOD FOR DEPOSITING UNIFORM CHARGE ON A THIN OXIDE SEMICONDUCTOR WAFER

[76] Inventors: Roger L. Verkuil, 37 Sherwood Hts., Wappinger Falls, N.Y. 12590; Gregory S. Horner, 3717 Carlysle Ave., Santa Clara, Calif. 95051; Tom G. Miller, 7077 Fox Hill Dr., Solon, Ohio 44139

[21] Appl. No.: 09/001,488

[22] Filed: Dec. 31, 1997

[51] Int. Cl.[7] ..... H01T 19/04

[52] U.S. Cl. ..... 250/326; 250/324; 361/224

[58] Field of Search ..... 250/326, 325, 250/324; 361/229, 224; 355/225

[56] References Cited

U.S. PATENT DOCUMENTS

| | | | |
|---|---|---|---|
| Re. 29,918 | 2/1979 | Verkuil . | |
| 3,206,674 | 9/1965 | Thuy et al. . | |
| 3,456,109 | 7/1969 | Gawron . | |
| 3,748,579 | 7/1973 | Henry et al. . | |
| 3,787,876 | 1/1974 | Pressman et al. | 250/324 |
| 4,049,343 | 9/1977 | Hermanson . | |
| 4,326,165 | 4/1982 | Szedon . | |
| 4,542,434 | 9/1985 | Gehlke et al. . | |
| 4,544,887 | 10/1985 | Kamieniecki . | |
| 4,563,642 | 1/1986 | Munakata et al. . | |
| 4,599,558 | 7/1986 | Castellano, Jr. et al. . | |
| 4,663,526 | 5/1987 | Kamieniecki . | |
| 4,704,576 | 11/1987 | Tributsch et al. . | |
| 4,780,680 | 10/1988 | Reuter et al. . | |
| 4,792,680 | 12/1988 | Lang et al. . | |
| 4,800,337 | 1/1989 | Cox et al. . | |
| 4,809,127 | 2/1989 | Steinman et al. . | |
| 4,812,756 | 3/1989 | Curtis et al. . | |
| 4,816,755 | 3/1989 | Look et al. . | |
| 4,827,212 | 5/1989 | Kamieniecki . | |
| 4,827,371 | 5/1989 | Yost . | |
| 4,873,436 | 10/1989 | Kamieniecki et al. . | |
| 4,891,584 | 1/1990 | Kamieniecki et al. . | |
| 4,901,194 | 2/1990 | Steinman et al. . | |
| 4,951,172 | 8/1990 | Steinman et al. . | |
| 4,956,603 | 9/1990 | Russo . | |
| 5,025,145 | 6/1991 | Lagowski . | |
| 5,055,963 | 10/1991 | Partridge . | |
| 5,087,876 | 2/1992 | Reiss et al. . | |
| 5,091,691 | 2/1992 | Kamieniecki et al. . | |
| 5,202,018 | 4/1993 | Horanyl et al. . | |
| 5,216,362 | 6/1993 | Verkuil . | |
| 5,266,892 | 11/1993 | Kimura . | |
| 5,343,293 | 8/1994 | Berger et al. . | |
| 5,406,214 | 4/1995 | Boda et al. . | |
| 5,453,703 | 9/1995 | Goldfarb . | |
| 5,498,972 | 3/1996 | Haulin . | |
| 5,498,974 | 3/1996 | Verkuil et al. . | |
| 5,594,247 | 1/1997 | Verkuil et al. . | |

FOREIGN PATENT DOCUMENTS

| | | |
|---|---|---|
| 53-84029 | 1/1980 | Japan . |
| 1122982 | 11/1984 | U.S.S.R. . |

OTHER PUBLICATIONS

Outside Electrochemical Society Publication, 1985, Abstract No. 284, pp. 415–416, 1985.

Semiconductor International, "A New Approach for Measuring Oxide Thickness," Tom G. Miller, Jul. 1995, Cahners Publishing Company, 2 Pages.

"COS Testing Combines Expanded Charge Monitoring Capabilities with Reduced Costs", Michael A. Peters, Semiconductor Fabtech 95, 4 Pages. No Dated.

Process Monitoring, "Corona Oxide Semiconductor Test", Semiconductor Test Supplement, Feb./Mar. 1995, pp. S–3 and S–5.

(List continued on next page.)

*Primary Examiner*—Kiet T. Nguyen

*Attorney, Agent, or Firm*—Pearne, Gordon, McCoy & Granger LLP

[57] ABSTRACT

A conductive slit screen is placed between a corona gun and the surface of a semiconductor wafer. The charge deposited on the wafer by the gun is controlled by a potential applied to the screen. A chuck orients the wafer in close proximity to the screen. A desired charge is applied to the wafer by depositing alternating polarity corona charge until the potential of the wafer equals the potential of the screen.

14 Claims, 1 Drawing Sheet

OTHER PUBLICATIONS

"A Contactless Method for High–Sensitivity Measurement of p–n Junction Leakage," IBM J. RES. Develop., vol. 24, No. 3, May 1980.

"A Novel Contactless Method for Measuring Collector–Isolation P–N Junction Capacitance in LSI Wafers," Electrochemical Society Paper, R.L. Verkuil, 1981, (6 pgs).

John Bickley, "Quantox Non–Contact Oxide Monitoring System", A Keithley Technology Paper, 1995, 6 Pages.

Gregory S. Horner, Meindert Kleefstra, Tom G. Miller, Michael A. Peters, "Monitoring Electrically Active Contaminants to Assess Oxide Quality", Solid State Technology, Jun. 1995, 4 pages.

B. H. Yun, "Direct Measurement of Flat–Band Voltage in MOS by Infared Excitation", (Received May 25, 1972), pp. 194–195.

R. G. Vyverberg, "VII. Charging Photoconductive Surfaces", Xerography and Related Processes, pp. 201–206, 1973.

"Measuring Work Functions of 'Dirty' Surfaces With a Vibrating Capacitive Probe", Langley Research Center, Hampton, Virginia. No Dated.

"Rechargable Magnesium Power Cells", Lyndon B. Johnson Space Center, Houston, Texas. No Dated.

R.B. Comizzoli, "Uses of Corona Discharges in the Semiconductor Industry", J. Electrochem. Soc.: Solid–State Science and Technology, Feb. 1987, pp. 424–429.

P. Edelman, "New Approach to Measuring Oxide Charge and Mobile Ion Concentration", Optical Characterization Techniques for High–Performance Microelectronic Device Manufacturing, SPIE vol. 2337, pp. 154–164. No Dated.

APPARATUS AND METHOD FOR DEPOSITING UNIFORM CHARGE ON A THIN OXIDE SEMICONDUCTOR WAFER

BACKGROUND OF THE INVENTION

The present invention relates to the measurement of semiconductor wafer characteristics and, more particularly, to the deposition of a desired charge upon the surface of such a wafer.

In order to perform various tests to characterize the electrical parameters and quality of semiconductor wafers, it is desirable to be able to produce uniform charge densities on the surface of the wafer.

For example, it is common to rinse a wafer in water to remove any charge that has accumulated on the oxide layer formed on the surface of the wafer.

Such a rinsing entails not only the rinsing step, but also, a drying step. This increases the chances for contamination and damage of the wafer. In addition, the drying process may reintroduce charge gradients.

U.S. Pat. No. 5,594,247, discloses an apparatus and method for depositing corona charge on a wafer and is incorporated herein by reference. A conductive grid is placed between a corona charge source and the wafer. A potential applied to the grid is used to control the amount of charge applied to the wafer. The invention disclosed in the patent provides excellent uniform charge deposition for wafers having thick oxide layers (e.g., greater than 150 Angstroms). However, as the oxide layer becomes thinner, the permissible voltage across the layer becomes smaller (e.g., 1 volt). As a result, second order effects that could previously be ignored need to be dealt with. In particular, work function variations (e.g., 10 to 100 millivolts) on the grid may create unacceptable variations in the deposited charge density. Areas, for example, less than 0.05 millimeters in diameter may have, for example, microgradients of 5E9 charges per centimeter squared per millimeter. Such a gradient would limit the lowest measurable interface state density to about 1.5E10 charges per centimeter squared per election volt at midgap.

These microgradients cause errors, for example, in the measurement of interface states charge densities in the wafer. In addition, microgradients cause further errors as smaller areas of a wafer are examined.

SUMMARY OF THE INVENTION

An apparatus for depositing a uniform charge on a surface of a semiconductor wafer includes an ion source, a conductive screen between the source and the surface. The screen has at least one slit-like aperture having a length and a width, the length being substantially greater than the width. The apparatus further includes a screen potential control for applying a desired potential to the screen and a translator for moving the aperture generally parallel to the width.

A method for depositing a uniform charge on a surface of a semiconductor wafer includes providing an alternating polarity ion source and providing a conductive screen between the source and the surface. The screen has at least one slit-like aperture having a length and a width, the length being substantially greater than the width. The method further includes providing a screen potential control for applying a desired potential to the screen, applying the desired potential to the screen, moving the aperture generally parallel to the width, and depositing charge on the wafer until the wafer has a potential equal to the desired potential.

DESCRIPTION OF THE PREFERRED EMBODIMENTS

Figure 1:
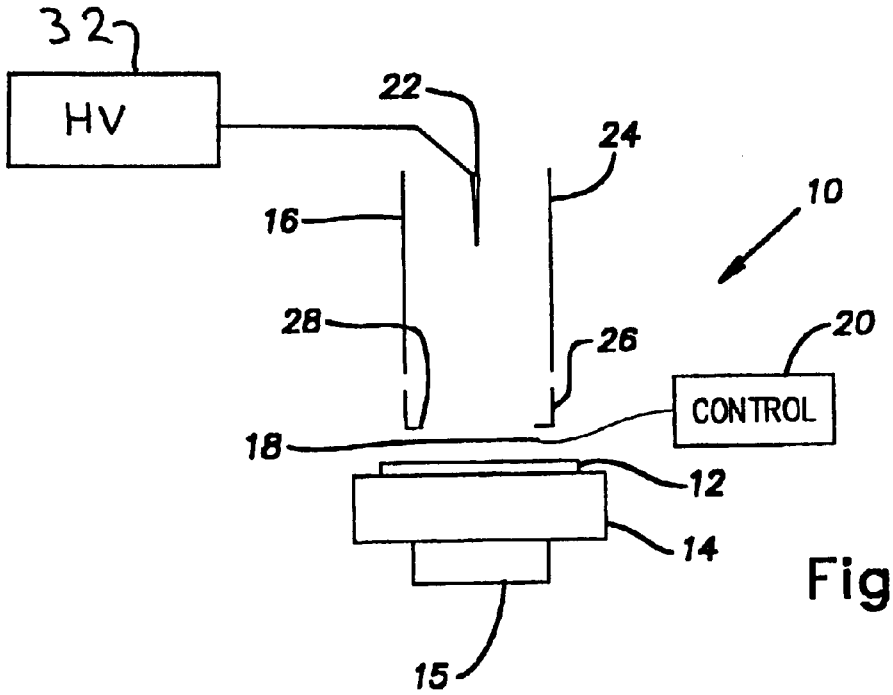
FIG. 1 is a schematic diagram of a side elevation view of an apparatus according to the invention.

Referring to FIG. 1, an apparatus 10 for depositing a desired charge on a surface of a semiconductor wafer 12 includes a chuck 14, an ion source 16, a screen 18 and a potential control 20.

In the preferred embodiment, the chuck 14 holds the wafer 12 with vacuum and the chuck 14 is mounted on a translation stage 15 or translator for moving the wafer 12 in the horizontal plane with respect to the ion source 16 and the screen 18. It is of course possible to make the chuck stationary and to move the ion source 16 and the screen 18 instead, or to use any other configuration that produces the desired relative movement between the wafer 12, and the ion source 16 and screen 18.

Similarly, the ion source 16 and the screen 18 may be mounted on a vertical positioning stage for adjusting the distance between the wafer 12 and the screen 18. The screen 18 may be, for example, adjusted to be from 5–10 mils from the surface of the wafer 12.

The potential control 20 is connected to the screen 18 to establish a desired potential on the screen 18.

The ion source 16 may include, for example, one or more tungsten needles 22 connected to an alternating polarity high voltage source 32 (e.g., plus or minus 6 to 9 KV). The polarity of the ions is determined by the polarity of the high voltage. The needle 22 is surrounded by a cylindrical upper electrode 24 connected to an unshown alternating polarity high voltage source (e.g., ±3 KV). A cylindrical mask electrode 26 with a partially closed end having a circular opening 28 is connected to an unshown alternating polarity high voltage source (e.g., ±1.5 KV). In the preferred embodiment, the polarity of the sources follow one another. In the preferred embodiment, the polarity changes, for example, at a rate between 10 and 20 hertz. Possible values include, for example, 0.01 to 10,000 hertz. The duty cycle of one polarity with the respect to the other may also be varied.

Figure 2:
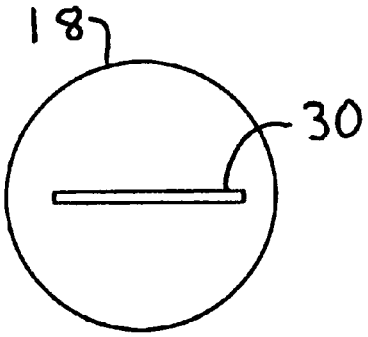
FIG. 2 is a plan view from above of a screen according to the invention.

Referring to FIG. 2, the screen 18 may be, for example, a 10 mils thick stainless steel sheet with a slit-like aperture 30 having, for example, a length of 500 mils and a width of 30 mils. The length may be, for example, 50 to 1,000 mils and the width may be, for example, 5 to 100 mils. In general, the length of the aperture 30 is substantially greater than the width. The length may be as long as the wafer diameter. For long apertures, a wire electrode may be used instead of a needle for the corona source.

In operation, the ion source 16 provides ions that move toward the wafer 12. Many of the ions are collected by the screen 18, but initially others travel through the aperture 30 and are deposited on the oxide layer of the wafer 12.

The wafer 12 is linearly translated in a horizontal plane under the ion source 16 and the screen 18 in a direction A that is parallel with the width of the aperture 30. Several parallel adjacent passes can be made until all the desired area of the surface of the wafer 12 is charged to the desired potential.

Using the aperture 30 with a high corona density source 16 (e.g., 1–3 microamperes per centimeter squared) avoids most of the work function and deposited charge variations that characterize the use of a fine grid on thin oxides. However, the deposited charge while being locally uniform is not uniform across the width of the aperture 30.

Figure 4:
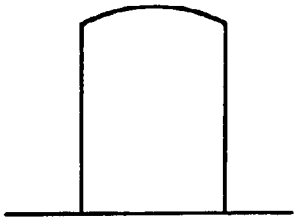
FIG. 4 is an exemplary graph of charge density for application of just positive corona charge on a wafer.
Figure 5:
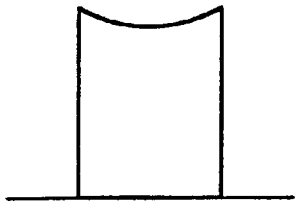
FIG. 5 is an exemplary graph of charge density for application of just negative corona charge on a wafer.

Referring to FIG. 4, for positive corona charge, an exemplary graph of the deposited charge density transverse to the direction A is illustrated. A dome-like convex density occurs along a length corresponding to the length of the aperture 30. Similarly, referring to FIG. 5, for negative corona charge, an exemplary graph of the deposited charge density transverse to the direction A is illustrated. A dome-like concave density occurs along a length corresponding to the length of the aperture 30.

In order to eliminate these dome-like gradients, alternating positive and negative corona are applied to cancel out the dome-like gradients. The depositing of charge continues until the potential of the wafer 12 and the screen 18 are equal.

If a 50 percent duty cycle is used between positive and negative polarities, the polarity of the ions is only correct half the time (i.e., capable of bringing the wafer surface 12 to the potential of the screen 18). In order to improve the speed of depositing the desired polarity, the duty cycle can be varied to initially favor the desired polarity.

Figure 3:
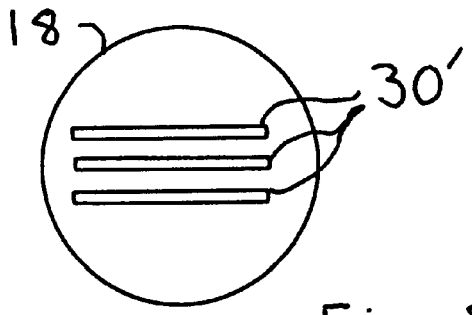
FIG. 3 is a plan view from above of an additional embodiment of a screen according to the invention.

Referring to FIG. 3, if faster charge deposition is desired, additional parallel apertures 30' (e.g., a total of 3 slits) can be added to the screen 18.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed:

1. An apparatus for depositing a uniform charge on a surface of a semiconductor wafer, said apparatus comprising:

an ion source;

a conductive screen between said source and said surface, said screen having at least one slit-like aperture, said aperture having a length and a width, said length being substantially greater than said width;

a screen potential control for applying a desired potential to said screen; and a translator, said translator moves said aperture generally parallel to said width.

2. An apparatus according to claim 1, wherein said ion source provides alternating polarity corona charges.

3. An apparatus according to claim 2, wherein said ion source alternates polarity at 10 to 20 hertz.

4. An apparatus according to claim 2, wherein said ion source alternates polarity at a variable duty cycle.

5. An apparatus according to claim 2, wherein said ion source eliminates dome-like gradients.

6. An apparatus according to claim 1, wherein said length is 50 to 1,000 mils and said width is 5 to 100 mils.

7. An apparatus according to claim 1, wherein there are a plurality of said slit-like apertures in substantially parallel arrangement.

8. A method for depositing a uniform charge on a surface of a semiconductor wafer, said method comprising:

providing an alternating polarity ion source;

providing a conductive screen between said source and said surface, said screen having at least one slit-like aperture, said aperture having a length and a width, said length being substantially greater than said width;

providing a screen potential control for applying a desired potential to said screen;

applying said desired potential to said screen;

moving said aperture generally parallel to said width; and depositing charge on said wafer until said wafer has a potential equal to said desired potential.

9. A method according to claim 8, wherein said ion source alternates polarity at 10 to 20 hertz.

10. A method according to claim 8, wherein said ion source alternates polarity at a variable duty cycle.

11. A method according to claim 8, further comprising alternating the polarity of said ion source such that dome-like gradients are eliminated.

12. A method according to claim 8, wherein said length is 50 to 1,000 mils and said width is 5 to 100 mils.

13. A method according to claim 8, wherein there are a plurality of said slit-like apertures in substantially parallel arrangement.

14. A method for depositing a uniform charge on a surface of a semiconductor wafer, said method comprising:

providing an alternating polarity ion source;

providing a conductive screen between said source and said surface, said screen having a plurality of slit-like apertures, each aperture having a length and a width, said length being substantially greater than said width;

providing a screen potential control for applying a desired potential to said screen;

applying said desired potential to said screen;

moving said apertures generally parallel to said width;

alternating the polarity of said ion source such that dome-like gradients are eliminated; and depositing charge on said wafer until said wafer has a potential equal to said desired potential.

* * * * *